United States Patent [19]

Fresard

[11] Patent Number: 4,506,117

[45] Date of Patent: Mar. 19, 1985

[54] ELECTROACOUSTIC TRANSDUCER

[75] Inventor: Marcel Fresard, Petit-Lancy, Switzerland

[73] Assignee: Multiphonie S.A., Geneva, Switzerland

[21] Appl. No.: 450,184

[22] Filed: Dec. 15, 1982

[30] Foreign Application Priority Data

Dec. 22, 1981 [CH] Switzerland ..... 8199/81

[51] Int. Cl.[3] ..... H04R 9/06

[52] U.S. Cl. ..... 179/114 R; 181/150; 179/115 R

[58] Field of Search ..... 179/181 W, 114 R, 115 R, 179/115.5 R, 117; 181/150, 172

[56] References Cited

U.S. PATENT DOCUMENTS

| | | | |
|---|---|---|---|
| 3,449,531 | 6/1969 | Ashworth | 179/181 W |
| 3,636,281 | 1/1972 | Cozart | 179/181 W |
| 3,728,497 | 4/1973 | Komatsu | 179/181 W |
| 3,925,627 | 12/1975 | Ashworth | 179/181 W |

FOREIGN PATENT DOCUMENTS

| | | | |
|---|---|---|---|
| 484872 | 2/1929 | Fed. Rep. of Germany | 179/181 W |
| 1447588 | 8/1976 | United Kingdom | 179/181 W |

*Primary Examiner*—Gene Z. Rubinson
*Assistant Examiner*—L. C. Schroeder
*Attorney, Agent, or Firm*—Emory L. Groff, Jr.

[57] ABSTRACT

The electroacoustic transducer comprises an oscillating element (6, 7) holding a coil (8), the oscillating element (6, 7) being connected to a magnet frame (11–17) by an elastomer ring (10'). The magnet frame (11–17) has two magnets (14, 15) and constitutes an inertial mass. The oscillating element (6, 7) is intended to be attached rigidly by its base plate (6) to a panel (1) so that the sound waves are transmitted to the latter (1) which thus plays the role of a speaker diaphragm. Adjusting screws (27) make it possible to modify the characteristics of the elastomer (10') as a function of the mounting condition and the desired sound diffusion effect.

1 Claim, 5 Drawing Figures

ELECTROACOUSTIC TRANSDUCER

This invention has as its object an electroacoustic transducer comprising a magnetic frame with a circular cylindrical air gap and an oscillating element holding a coil placed in this air gap.

For emitting sound waves, one or more speakers are used which exhibit by their nature a rather marked directional effect.

The sound emission is hindered by reflections against the walls of the places where they are produced.

In the case of stereophonic diffusion, it is necessary that the listener be at the point of convergence of the waves emitted by two or more speakers. This necessity is rarely compatible with a harmonious interior arrangement, and the inegration of a speaker, often of large dimensions, with the furniture of a room is not generally esthetic.

The object of this invention is to eliminate these drawbacks and to make possible a much more homogeneous sound diffusion exhibiting fewer directional effects than in the case of the diffusion of sound waves by speakers.

For this purpose, the electroacoustic transducer according to this invention is characterized by the fact that the oscillating element is rigid and is shaped to make it possible to attach it to a panel, the magnetic frame playing the role of inertial mass and being connected to the oscillating element by at least an elastomer piece.

The invention further relates to a use of said electroacoustic transducer in a unit for the emission of sound waves, characterized by the fact that said transducers are rigidly fastened by their oscillating element to panels so as to transmit to the latter vibrations generating sound waves.

The accompanying drawings diagrammatically shows, by way of example, two embodiments of the invention.

Figure 1:
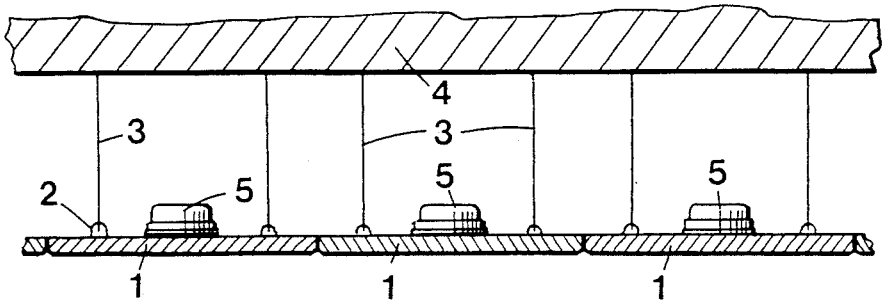
FIG. 1 is a vertical section of a suspended ceiling, provided with electroacoustic transducers according to the invention.

In reference to FIG. 1, a suspended ceiling consists in a known way of panels 1, having, on their upper face, loops 2 for the passage of hooks 3, themselves fastened to a slab 4, constituting the floor of an upper floor.

Several of these panels 1 are provided with one or more electroacoustic transducers 5. The latter are made solid with the panel 1 by their metal base plate 6.

Figure 2:
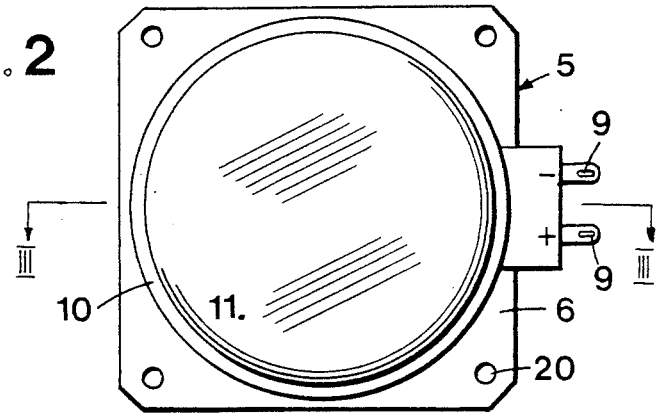
FIG. 2 is a top view of the transducer according to the first embodiment.

This metal base plate 6 has holes 20 to make it possible to screw it to the wall element (FIG. 2).

Figure 3:
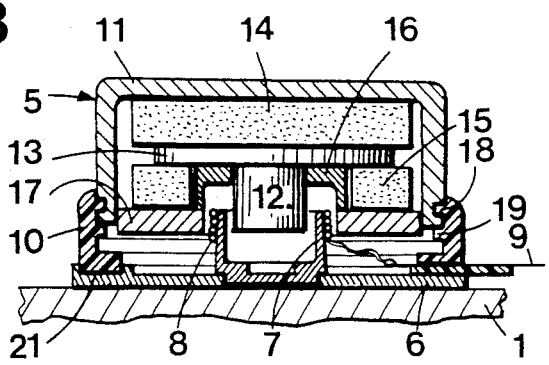
FIG. 3 is a section along line III—III of FIG. 2.

The design of the transducer shown in FIGS. 2 and 3 is very near that of a speaker. The metal base plate 6 has a central cylindrical part 7 of non-ferromagnetic material, for example, aluminum. This cylindrical part holds a coil 8 whose two ends are connected to two contact pins 9 and 9'.

The base metal plate 6, its cylindrical part 7 and the coil 8 together constitute an oscillating element of the transducer 5.

As shown in FIG. 3 the transducer has a magnetic frame comprising a ferromagnetic central part 12 solid with a flange 13, a disk-shaped permanent magnet 14, a ring-shaped permanent magnet 15, a bell-shaped part 11 and a flat metal ring 17. The flange 13 is placed between the disk-shaped magnet 14 and the ring-shaped magnet 15 and a ring-shaped part 16 of non-ferromagnetic material holds the magnet 15 centered in relation to the central part 12.

The magnetic frame 11 to 17 is connected to the plate 6 by an elastomer piece 10. This piece 10 constitutes an annular dust seal between the plate 6 and the bell-shaped part 11.

It should be noted that the elastomer piece 10 has two inner annular ribs 18 and 19, the first is engaged in a peripheral groove at the base of the skirt of the bell-shaped part 11.

The base of the piece 10 is engaged in a wide centering groove 21 provided in the plate 6.

The cylindrical part 7 and the coil 8 are engaged in a cylindrical space provided between the central part 12 and the annular centering part 16.

The elastomer piece 10 has sufficient flexibility to make possible relative axial movements between the cylinder 7 and the central core 12, while assuring good radial guiding between said core 12 and the cylinder 7.

The magnetic frame with the magnets 14 and 15 constitutes a relatively heavy part which acts as an inertial mass so that the relative movements between the core 12 and the cylinder 7 transmit vibrations to the plate 6 and therefore to the panels 1 of the suspended ceiling.

These panels play the role of a speaker diaphragm. In most cases, the wall element has a large surface which makes possible good reproduction quality of the musical signals, especially low notes.

Of course, it is necessary to choose the number of transducers 5 as a function of the sound level that it is desired to be obtained in the space which is to be filled with sound.

There is no question that the transducers 5 must be connected so as to be in phase with one another.

It is clear that the transducers can be attached to any other wall element, this wall could be a wall of the room to be filled with sound or even a wall of a piece of furniture located in this room.

At a minimum a single transducer can be sufficient when the room does not have large dimensions.

Figure 4:
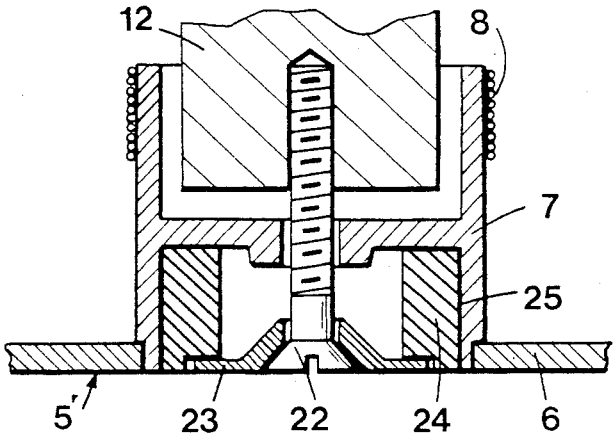
FIG. 4 is a partial view in axial section of a variant of the electroacoustic transducer of FIG. 3.

According to a modification shown in FIG. 4, the transducer 5' has means for exerting a force on the elastomer piece 10 so as to modify its characteristics of elasticity. These means comprise a central adjusting screw 22 connecting the magnet frame 11–17 to the oscillating element 6–8. The head of the adjusting screw 22 engages a washer 23 and the latter in turn abuts an elastic element consisting of a rubber sleeve 24 inserted in a recess 25 provided in the central part of the metal plate 6 of the oscillating element 6–8. The screw 22 is engaged by its other end in a threaded hole of the central part 12. By action on the adjusting screw 22, it is thus possible to apply a more or less strong force on the elastomer piece 10 so as to obtain optimum conditions for diffusion of the sound waves.

Figure 5:
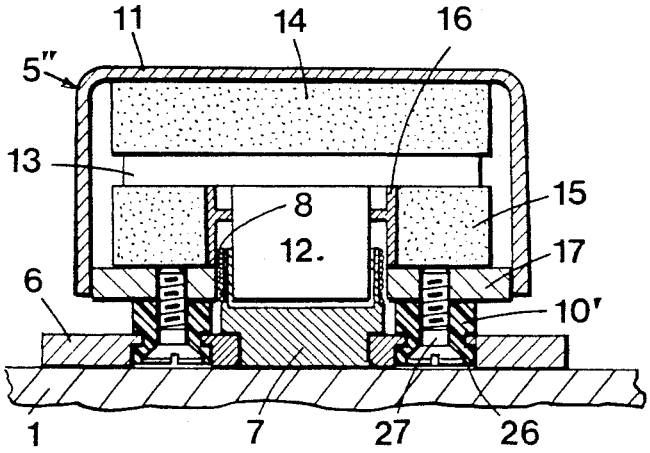
FIG. 5 is an axial section of the second embodiment of the transducer.

Another embodiment of the electroacoustic transducer is shown in FIG. 5. This embodiment is distinguished from the preceeding by the fact that the elastomer piece 10 instead of being placed on the periphery of the skirt of the bell-shaped part 11, is inserted in the shape of an elastomer ring 10' between the base plate 6 and the metal ring 17.

The base plate 6 has four holes 26 through which four adjusting screws 27 are introduced. The latter 27 pass through the elastomer ring 10' and are engaged in threaded holes of the metal ring 17. A more or less strong tightening of these screws makes it possible to adjust the characteristics of elasticity of the elastomer piece 10' as a function of the mounting conditions and the desired sound diffusion effect. It should be noted that the elastomer ring 10' constitutes a dust seal protecting the internal components of the transducer.

According to a modification the elastomer ring 10' could be replaced with four elastomer studs engaged in the holes 26 of the base plate and through which the adjusting screws 27 pass. In this modification, the internal components of the transducers are no longer protected from dust, unless an additional seal is provided for this purpose.

I claim:

1. An electroacoustic transducer (5) comprising a magnetic frame (11–17) provided with a circular cylindrical air gap and including a bell shaped member (11), an oscillating element including a metal base plate (6), a cylindrical part (7) and a coil (8), said coil (8) mounted on said cylindrical part (7) and disposed in said air gap, said metal plate (6) provided with holes (20) to permit attachment of said oscillating element to a panel (1) by screw means, said magnetic frame (11–17) constituting an inertial mass and connected to said base plate by means of an elastomer member (10), characterized in that said elastomer member (10) comprises a ring which is connected in an air tight, dust free manner to said magnetic frame and to said metal plate (6), said ring including a pair of annular ribs (18,19), one of said ribs (18) engaged in a peripheral groove in said magnetic frame (11–17), the other said rib (19) supporting the lower edge of said bell shaped member (11), said base plate having a groove (21) therein, the base of said ring engaged in said last mentioned groove, means (22–24) for exerting force on said elastomer member (10) in such a manner as to modify its characteristics of elasticity, in said means for exerting force on said elastomer member (10) comprising a screw (22) coaxial with said coil (8), said screw connecting said magnetic frame (11–17) to said oscillating element (6–8), the cylindrical part (7) of said oscillating element having a recess (25) therein, an elastic sleeve (24) in said recess, one end of said sleeve abutting an end wall of said recess, the head of said screw engaging the other end of said sleeve, the other end of said screw threadedly engaged in a magnet (12) of said magnetic frame, whereby adjustment of said screw increases or decreases the force on said elastic sleeve to obtain optimum conditions of diffusion of sound waves.

* * * * *